US010648623B2

(12) United States Patent
De Visser et al.

(10) Patent No.: US 10,648,623 B2
(45) Date of Patent: May 12, 2020

(54) LIGHT SOURCE, LAMP, AND METHOD FOR MANUFACTURING A LIGHT SOURCE

(71) Applicant: SIGNIFY HOLDING B.V., Eindhoven (NL)

(72) Inventors: Alexander Paul Johannus De Visser, Vierhouten (NL); Martijn Jeroen Dekker, Groningen (NL)

(73) Assignee: SIGNIFY HOLDING B.V.

( * ) Notice: Subject to any disclaimer, the term of this patent is extended or adjusted under 35 U.S.C. 154(b) by 1037 days.

(21) Appl. No.: 14/042,751

(22) Filed: Oct. 1, 2013

(65) Prior Publication Data

US 2015/0092419 A1 Apr. 2, 2015
US 2016/0327212 A9 Nov. 10, 2016

Related U.S. Application Data

(63) Continuation of application No. PCT/EP2012/056000, filed on Apr. 2, 2012.
(Continued)

(51) Int. Cl.
*F21V 3/02* (2006.01)
*F21K 9/20* (2016.01)
(Continued)

(52) U.S. Cl.
CPC ..... *F21K 9/20* (2016.08); *F21K 9/232* (2016.08); *F21K 9/235* (2016.08); *F21K 9/60* (2016.08);
(Continued)

(58) Field of Classification Search
CPC ..... F21V 3/02
(Continued)

(56) References Cited

U.S. PATENT DOCUMENTS 6,086,218 A * 7/2000 Robertson ..... F21L 4/027 340/815.73
6,163,556 A 12/2000 Oskarsson
(Continued)

FOREIGN PATENT DOCUMENTS

EP 1298382 A1 4/2003
EP 1970620 A1 9/2008
(Continued)

OTHER PUBLICATIONS

Coy of Search Report of PCT/EP2012/056000 dated Jun. 27, 2012.

*Primary Examiner* — Christopher M Raabe
(74) *Attorney, Agent, or Firm* — Akarsh P. Belagodu

(57) ABSTRACT

The invention relates to an LED light source comprising a light unit and a hollow curved cap covering the light unit. The light unit comprises a plurality of light emitting diodes (LEDs) distributed in the form of a spatial arrangement having a center position. The plurality of LEDs includes at least two different types of LEDs. Each type of LED is arranged for the emission of radiation within a different wavelength range. The cap is substantially transparent for radiation emitted by the light unit. The cap is further provided with an axially symmetric protrusion forming a depression in the exterior of the cap. The symmetry axis of the protrusion substantially coincides with the center position of the spatial arrangement of the plurality of LEDs.

23 Claims, 3 Drawing Sheets

Related U.S. Application Data

(60) Provisional application No. 61/470,597, filed on Apr. 1, 2011.

(51) Int. Cl.

| | |
|---|---|
| ***F21K 9/232*** | (2016.01) |
| ***F21K 9/60*** | (2016.01) |
| ***F21K 9/235*** | (2016.01) |
| *F21Y 113/13* | (2016.01) |
| *F21Y 115/10* | (2016.01) |

(52) U.S. Cl.
CPC ..... *F21V 3/02* (2013.01); *F21Y 2113/13* (2016.08); *F21Y 2115/10* (2016.08)

(58) Field of Classification Search
USPC ..... 362/293
See application file for complete search history.

(56) References Cited

U.S. PATENT DOCUMENTS

| | | | | |
|---|---|---|---|---|
| 6,350,041 | B1 | 2/2002 | Tarsa et al. | |
| 6,796,698 | B2 | 9/2004 | Sommers et al. | |
| 7,021,797 | B2 | 4/2006 | Minano et al. | |
| 7,753,561 | B2 | 7/2010 | Chaves et al. | |
| 2003/0072156 | A1 | 4/2003 | Pohlert et al. | |
| 2006/0018122 | A1* | 1/2006 | Negley | 362/326 |
| 2006/0083017 | A1* | 4/2006 | Wang | B64F 1/20 362/547 |
| 2009/0086492 | A1* | 4/2009 | Meyer | 362/294 |
| 2009/0196641 | A1 | 8/2009 | Banton et al. | |
| 2010/0254128 | A1 | 10/2010 | Pickard et al. | |
| 2011/0286200 | A1* | 11/2011 | Iimura et al. | 362/84 |
| 2012/0262915 | A1* | 10/2012 | Lin et al. | 362/235 |
| 2013/0010232 | A1* | 1/2013 | Takahashi et al. | 349/64 |
| 2013/0148350 | A1* | 6/2013 | Yriberri et al. | 362/235 |
| 2013/0176741 | A1* | 7/2013 | Nakamura et al. | 362/347 |

FOREIGN PATENT DOCUMENTS

| | | | | |
|---|---|---|---|---|
| GB | 2460703 | A | 12/2009 | |
| WO | 2010079391 | A1 | 7/2010 | |
| WO | 2010079436 | A1 | 7/2010 | |
| WO | 2010079439 | A1 | 7/2010 | |
| WO | WO 2010079391 | A1 * | 7/2010 | F21K 9/52 |
| WO | 2011010535 | A1 | 1/2011 | |

* cited by examiner

LIGHT SOURCE, LAMP, AND METHOD FOR MANUFACTURING A LIGHT SOURCE

CROSS REFERENCE TO RELATED APPLICATIONS

This application is a continuation of PCT application number PCT/EP2012/056000 filed on 2 Apr. 2012, which claims priority from U.S. Provisional application No. 61/470,597 filed on 1 Apr. 2011. Both applications are hereby incorporated by reference in their entirety.

BACKGROUND OF THE INVENTION

1. Field of the Invention

Conventional incandescent light sources generally provide radial distribution of light which is used to illuminate a room or the like. However, incandescent light sources consume a lot of power. Replacing incandescent light sources with light emitting diode (LED) light sources improves the power efficiency considerably. Unfortunately, most LEDs emit light into a hemisphere, whereas incandescent light sources are able to provide substantially uniform light emission into an entire sphere. As a result, the mere replacement of incandescent light sources by LED light sources often leads to unsatisfactory and/or insufficient illumination of a space, such as a room.

In addition, conventional incandescent light sources generate a broad spectrum that is experienced as warm white light. LEDs do not generate white lights by themselves. White light may be obtained by using LEDs emitting a short wavelength, e.g. a wavelength between about 420-470 nm, covered with phosphorous material which converts a portion of the emitted light into light having a longer wavelength. The white light produced in this way is often experienced as "cold". Alternatively, white light may be obtained by using different types of LEDs, each type being suitable for the emission of a wavelength in a different wavelength region. For example, LEDs arranged for emitting blue light may be combined with one or more LEDs arranged for emitting green light and red light. By specific arrangements and the use of optical elements to obtain color mixing white light may be formed. However, it is very difficult to obtain a rather uniform emission of white light over a large solid angle.

Generally, the differences between incandescent light sources and light sources using LEDs described become more noticeable when pluralities LEDs are used in LED light sources. It is extremely difficult to realize a light source using a plurality of LEDs that may act as a point source, particularly if such behavior should coincide with sufficient color mixing.

BRIEF SUMMARY OF THE INVENTION

The object of the invention is to provide a light source using LEDs which provide improved illumination over a large solid angle in a rather uniform way. For this purpose, an embodiment of the invention provides a light source comprising: a light unit comprising a plurality of light emitting diodes distributed in the form of a spatial arrangement having a center position, wherein the plurality of light emitting diodes includes at least two different types of diodes, each type of diode being arranged for the emission of radiation within a different wavelength range; and a hollow curved cap covering the light unit, the cap being substantially transparent for radiation emitted by the light unit and being provided with an axially symmetric depression forming a protrusion in the interior of the cap, wherein the symmetry axis of the depression substantially coincides with the center position of the spatial arrangement of the plurality of light emitting diodes. The use of this light source provides a rather uniform emission of light over a large solid angle while benefiting from the power efficiency of LEDs.

Embodiments of the invention further relate to a lamp comprising a light source as mentioned above and a hollow enclosure at least partially enclosing the optical element, wherein at least a portion of the enclosure is transparent for radiation emitted by the optical element.

Embodiments of the invention further relate to a light assembly comprising: a light source as mentioned above; and a luminaire for accommodating the light source; wherein the radius of a virtual hemisphere tangent to the light source is at least 10 times smaller than the radius of a virtual hemisphere tangent to the luminaire. Such light assembly may not only be able to provide improved illumination over a large solid angle in a rather uniform way, but may also enable the light source to be used as a point source. This may even be the case for a light source using a plurality of LEDs.

Finally, embodiments of the invention relate to a method of manufacturing a light source comprising: forming a light unit by distributing a plurality of light emitting diodes in the form of a spatial arrangement having a center position, the plurality of light emitting diodes including at least two different types of diodes, each type of diode being arranged for the emission of radiation within a different wavelength range; molding a hollow curved cap being substantially transparent for radiation emitted by the light unit, the cap being provided with an axially symmetric depression forming a protrusion in the interior of the cap; and placing the cap over the light unit so as to cover it, wherein the placement is such that the symmetry axis of the depression substantially coincides with the center position of the spatial arrangement of the plurality of light emitting diodes.

BRIEF DESCRIPTION OF THE DRAWINGS

Various aspects of the invention will be further explained with reference to embodiments shown in the drawings wherein.

DESCRIPTION OF ILLUSTRATIVE EMBODIMENTS

The following is a description of various embodiments of the invention, given by way of example only and with reference to the drawings.

Figure 1:
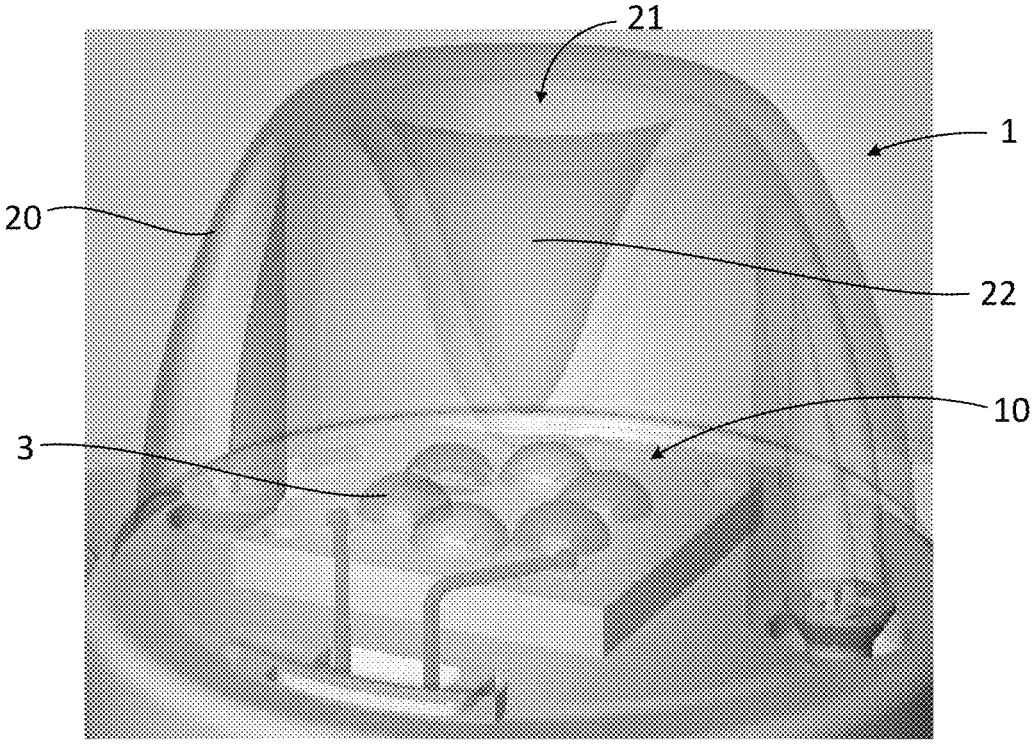
FIG. 1 schematically shows an elevated view of a light source according to an embodiment of the invention.

FIG. 1 schematically shows an elevated view of a light source 1 according to an embodiment of the invention. The light source 1 comprises a light unit 10 and a cap 20. The light unit 10 comprises a plurality of light emitting diodes 3 (LEDs) including at least two different types of LEDs. Each type of LED is arranged for the emission of radiation with a different wavelength range.

The LEDs 3 are distributed in the form of a spatial arrangement. The choice of a specific arrangement may be based on the desired purpose. Two examples of spatial arrangements are given in FIGS. 2*a* and 2*b*.

The cap 20 is a hollow curved cap and covers the light unit 10. The cap 20 is substantially transparent for radiation emitted by the light unit 10. The cap is provided with an axially symmetric protrusion 22 in the interior of the cap 20. The protrusion forms a depression 21 in the exterior of the cap 20. The symmetry axis of the protrusion 21 substantially coincides with the center position of the spatial arrangement of the plurality of LEDs 3. The alignment of the protrusion 22 with the LEDs 3 enables increased mixing of light emitted by the different types of LEDs 3. As a result, improved color mixing can be achieved.

Furthermore, the use of the hollow cap 20 with the protrusion 22, and resulting depression 21, enables the light source 1 to emit light in a substantially uniform fashion over a solid angle that exceeds the solid angle of the light emitting diodes. Due to the alignment of the symmetry axis of the protrusion 22 with the center position of the spatial arrangement of the plurality of light emitting diodes 3 the solid angle of the light source 1 may approximate the solid angle of a point source.

Figure 2A:
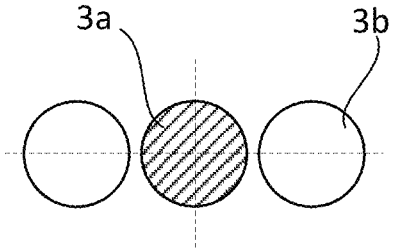
FIG. 2*a* schematically shows a top view of a spatial arrangement of light emitting diodes that may be used in embodiments of the invention.
Figure 2B:
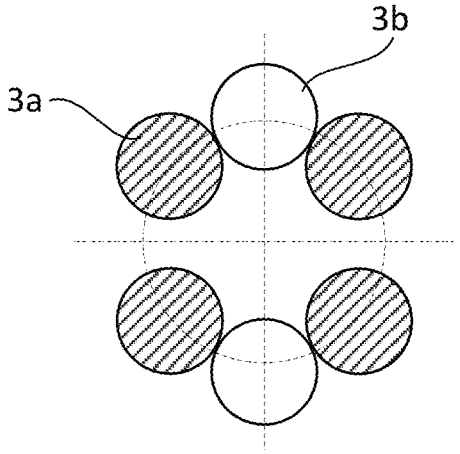
FIG. 2*b* schematically shows a top view of another spatial arrangement of light emitting diodes that may be used in embodiments of the invention.

FIGS. 2*a* and 2*b* schematically show a top view of two different spatial arrangements LEDs that may be used in embodiments of the invention. Both shown arrangements comprise two different types of LEDs. It will be understood that embodiments of the invention are not limited to the use of merely two different types of LEDs. The LEDs of a first type in FIGS. 2*a*, 2*b* are represented as dashed circles and will be referred to as LEDs 3*a*. The LEDs of a second type are represented by the white circles and will be referred to as LEDs 3*b*.

In FIG. 2*a*, one LED 3*a* is used in combination with two LEDs 3*b*. The single LED 3*a* is positioned at the center position of the spatial arrangement of LEDs, while the two LEDs 3*b* are equidistantly placed at opposing sides of the single LED 3*a*.

In FIG. 2*b*, four LEDs 3*a* are arranged in a square formation, while two LEDs 3*b* are arranged on a virtual line separating the square formation in two. As a result, the center position of the spatial arrangement corresponds to both the center position of the square and the center position of the line. Furthermore, the LEDs 3*a*, 3*b* are all positioned in a circular arrangement with an origin that coincides with the center position of the spatial arrangements of the different types of LEDs 3*a*, 3*b*. This highly symmetric arrangement of LEDs 3*a*, 3*b* has an improved performance regarding emission of light with substantially uniform properties, for example related to color and intensity, over a large solid angle.

Some embodiments of the inventions are particularly useful for the generation of white light by mixing the spectra of two or more different types of LEDs. For example, one of the LED types 3*a*, 3*b* being used may correspond to an LED provided with a layer comprising a phosphorous compound. The phosphorous compound is arranged to convert at least a portion of the radiation emitted by the LED into radiation having a different, generally a longer, wavelength. In such case, this type of diode may be a so-called "white LED", i.e. an LED which produces white light by mixing the light emitted by the LED with light converted by the phosphorous layer. Typically a white LED uses an LED arranged for emitting wavelengths in a range of about 420-470 nm. The light emitted by "white LEDs" generally have a low color rendering index, i.e. the emitted light is perceived as being "cold" light. The use of diodes emitting wavelengths in a range of about 590-670 nm, i.e. red LEDs, can improve the perception of the light emitted by the light source.

Figure 3A:
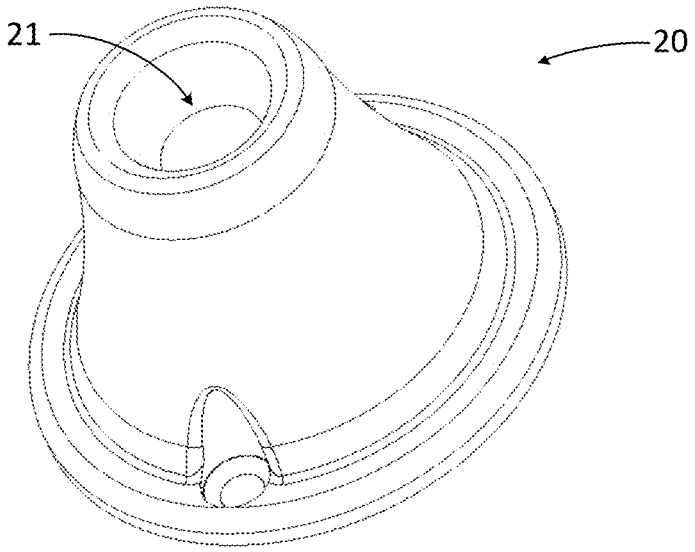
FIG. 3*a* schematically shows an elevated view of a cap that may be used in embodiments of the invention.
Figure 3B:
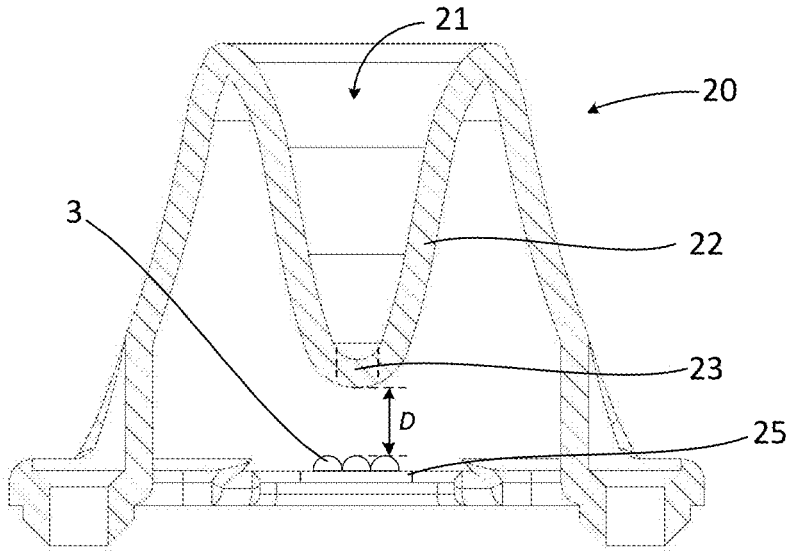
FIG. 3*b* schematically shows a cross-sectional view of the cap of FIG. 3*a;*
Figure 3C:
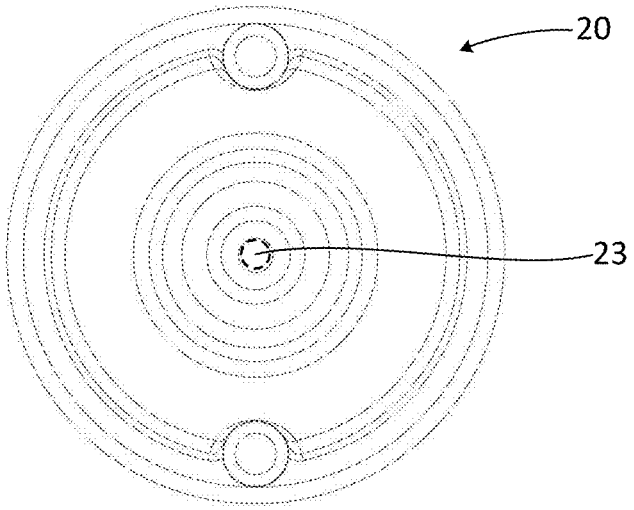
FIG. 3*c* schematically shows a top view of the cap of FIG. 3*a;*

FIG. 3*a* schematically shows an elevated view of a cap 20 that may be used in embodiments of the invention. FIGS. 3*b* and 3*c* schematically show a cross-sectional view and a top view of the cap 20 of FIG. 3*a*, respectively. Suitable materials for the cap 20 include, but are not limited to, transparent plastics, for example transparent thermoplastics such as poly-methyl-methacrylate (PMMA) or polycarbonate (PC).

The protrusion 22 is preferably cone-shaped. The use of a cone-shaped protrusion 22 improves uniform transmission over a large solid angle. Light emitted from the LEDs is more likely to reflect on the inner surface of the cap, which provides a better angular dispersion of light. Additionally, the increased light dispersion results in improved color mixing which improves the uniformity of the light being emitted by the light source. A further improvement of light dispersion and color mixing can be achieved by shaping the protrusion 22 such that a top portion of the protrusion has a convex surface shape if observed from the direction of the light unit 10. In other words, in this embodiment, the top portion of the protrusion 22 has a convex outer surface shape.

At least a portion of the inner surface of the cap 20 may be smoothened such that it has a gloss factor higher than 80. The use of smoothened inner surface further increases specular reflection at the inner surface of the cap 20, which enhances dispersion and color mixing throughout the light source. Alternatively, or additionally, at least a portion of the inner cap surface may be coated with a partially reflective layer. Preferably, such coated portion includes the protrusion surface. A suitable material that may be part of such partially reflective layer is chrome.

A further improvement in color mixing can be achieved by roughening at least a portion of the outer surface of the cap 20, such that the outer surface is provided with a texture. Due to the textured outer surface light will refract at almost random angles while leaving the cap material, which greatly enhances color mixing.

Optionally, the protrusion 22 comprises a center hole 23 (denoted by dashed lines). The use of a hole 23 improves the cooling capacity of the light source. Furthermore, in case the cap 20 is made by using a molding technique, keeping the central area of the protrusion 22 free of material avoids the presence of a surplus of material at this point, which could have a negative influence on the performance of the light source in terms of uniformity of light emission in all directions.

Preferably, a cap 20 with a hole 23 is used in combination with a spatial arrangement of LEDs 3 of which the center position is free of LEDs 3. An example of such spatial arrangement is shown in FIG. 2*b*. The exemplary spatial arrangement of FIG. 2*a* would be less suitable, because this arrangement includes an LED in the center position. An LED 3 that is located at the center position would emit light through the hole 23 directly, which is undesirable.

Preferably, a distance D between the top of the protrusion 22 and the center point of the spatial arrangement of LEDs 3 is at least 2 mm. The use of this minimal distance ensures that a majority of the light emitted by the LEDs 3 is not directly emitted onto the top portion of the protrusion 22. Preferably the distance D is not too large to enable light to mix throughout a large portion of the space covered by the cap 20. The spatial arrangement of LEDs 3 is often placed on a board 25. Preferably, the distance D is smaller than about half the characteristic dimension of the board 25. The characteristic dimension may vary per board shape. For example, the characteristic dimension of a rectangular structure is its diagonal, while the characteristic dimension of a circular structure is the circle diameter. So, in case the LEDs 3 are organized on a rectangular board having a diagonal of about 16 mm, the preferable maximum distance D would be about 8 mm.

The light source described above can be manufactured in the following way. First, a light unit and a cap are manufactured separately. The light unit is formed by distributing a plurality of LEDs in the form of a spatial arrangement having a center position. The plurality LEDs includes at least two different types of LEDs. Each type of LED is arranged for the emission of radiation within a different wavelength range.

The hollow curved cap is manufactured by molding a material that is substantially transparent for radiation emitted by the light unit, for example a thermoplastic such as PMMA or PC. The cap is provided with an axially symmetric protrusion forming a depression in the exterior of the cap. As described above, in some embodiments, the protrusion comprises a through hole at the center. This may be achieved by supporting the cap in such a way that the center of the protrusion, and thus also the center of the depression, remains free of molding material.

When the light unit and the cap are ready, the cap is placed over the light unit so as to cover it. The placement is such that the symmetry axis of the protrusion substantially coincides with the center position of the spatial arrangement of the plurality of LEDs.

Figure 4:
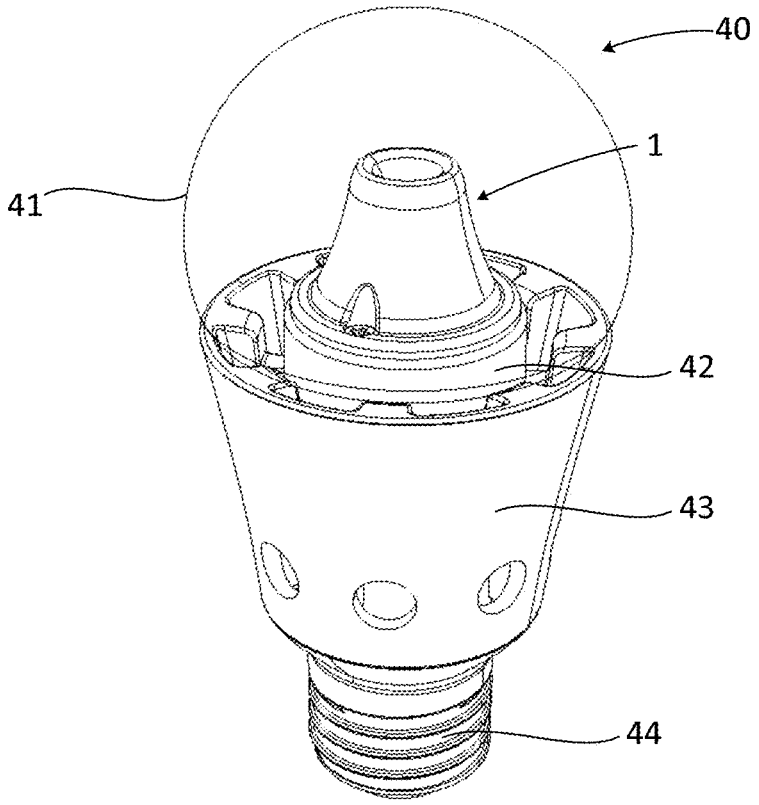
FIG. 4 schematically shows a lamp according to an embodiment of the invention.

FIG. 4 schematically shows a lamp 40 according to an embodiment of the invention. The lamp 40 comprises a light source 1 as described above. The lamp 40 further includes a hollow enclosure 41 which, at least partially, encloses the light source 1. At least a portion of the enclosure 41 is transparent for radiation emitted by the light source 1. The lamp 40 may further comprise a base 42 for accommodating the light source. The base 42 may further comprise a cooling body 43 for enabling fast removal of heat away from the LEDs. The base 42 may be provided with a connection structure 44 for electrical connection. The connection structure 44 may be suitable for retrofitting into a luminaire arranged for the utilization of an incandescent light source. Such retrofitting enables the use of a power efficient LED light source instead of an incandescent light source without the need to replace a luminaire formerly used to accommodate the incandescent light source.

Figure 5:
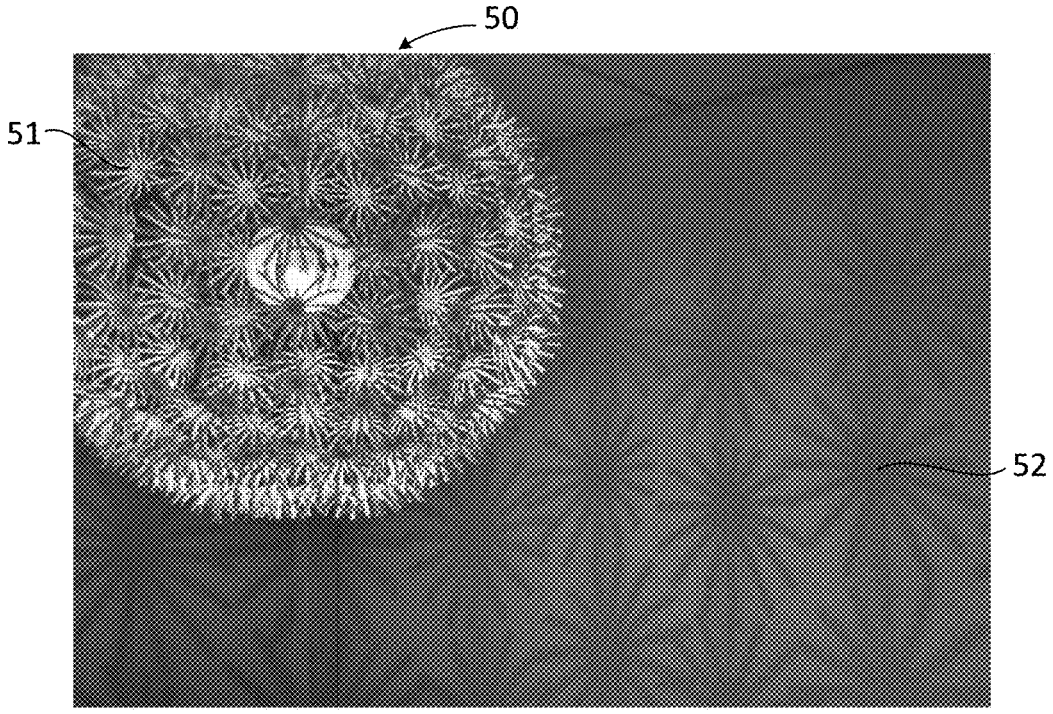
FIG. 5 is a photograph showing a light assembly according to an embodiment of the invention.

FIG. 5 is a photograph showing a light assembly 50 according to an embodiment of the invention. The light assembly shown comprises an embodiment of a light source as described above that is accommodated by a luminaire 51. The radius of a virtual hemisphere tangent to the light source is much smaller than the radius of a virtual hemisphere tangent to the luminaire. Consequently, the LED light source acts as a point source emitting light over a large solid angle. The luminaire shown in FIG. 5 contains figurative portions forming shadows 52 on the wall of the chamber in which the luminaire is displayed. The contrast between illuminated portions on the wall and the shadows is substantially uniform, which demonstrates that an LED light source as described above can act as a point source when placed within a sufficiently larger luminaire.

It has been found that the point source behavior is particularly profound when the radius of a virtual hemisphere tangent to the light source is at least 10 times smaller than the radius of the virtual hemisphere tangent to the luminaire that accommodates the light source. Preferably, the radius of the virtual hemisphere tangent to the light source is smaller than 50 mm, more preferably smaller than 25 mm. A virtual hemisphere tangent to the light source of relatively small size enables the use of luminaires of relatively small size as well while still benefiting from the point source behavior of the light source.

The invention has been described by reference to certain embodiments discussed above. It will be recognized that these embodiments are susceptible to various modifications and alternative forms well known to those of skill in the art without departing from the spirit and scope of the invention. Accordingly, although specific embodiments have been described, these are examples only and are not limiting upon the scope of the invention, which is defined in the accompanying claims.

What is claimed is:

1. A light source comprising:

a light unit comprising a plurality of light emitting diodes distributed in a spatial arrangement of the plurality of light emitting diodes, the spatial arrangement having a center position, wherein the plurality of light emitting diodes includes at least two different types of diodes, each type of diode being configured to emit light within a different wavelength range; and a hollow curved cap covering the light unit, the cap being substantially transparent to radiation emitted by the light unit and being provided with an axially symmetric protrusion forming an exposed depression in the exterior of the cap, wherein the protrusion includes a surface that is convex with respect to the plurality of light emitting diodes and that at least partially defines a cavity in which the plurality of light emitting diodes is disposed, and wherein the symmetry axis of the protrusion substantially coincides with the center position of the spatial arrangement of the plurality of light emitting diodes.

2. The light source of claim 1, wherein the protrusion is substantially cone-shaped.

3. The light source of claim 1, wherein at least a portion of the inner surface of the cap has a gloss factor higher than 80.

4. The light source of claim 1, wherein at least a portion of the inner surface of the cap is coated with a partially reflective layer.

5. The light source of claim 1, wherein at least a portion of the outer surface of the cap is textured.

6. The light source of claim 1, wherein at least one of the different types of diodes is a converting diode provided with a layer comprising a phosphorous compound to convert at least a portion of the light emitted by the converting diode into light having a different wavelength.

7. The light source of claim 6, wherein the converting diode is a light emitting diode configured to emit wavelengths in a range of about 420-470 nm.

8. The light source of claim 1, wherein at least one of the different types of diodes is configured to emit wavelengths in a range of about 590-670 nm.

9. The light source of claim 1, wherein a distance D between the protrusion and the center point of the spatial arrangement is at least 2 mm.

10. The light source of claim 9, wherein the spatial arrangement is placed on a board with a characteristic dimension, and wherein the distance D is smaller than about half the characteristic dimension of the board.

11. The light source of claim 1, wherein the protrusion comprises a through hole at the symmetry axis of the protrusion.

12. The light source of claim 1, wherein the spatial arrangement of the plurality of light emitting diodes is a circular arrangement.

13. The light source of claim 1, wherein the center position of the spatial arrangement of the plurality of light emitting diodes is free of diodes.

14. A lamp comprising:

a light source according to claim 1;

a hollow enclosure at least partially enclosing the light source, wherein at least a portion of the enclosure is transparent to radiation emitted by the light source.

15. The lamp according to claim 14, further comprising a base for accommodating the light source, the base being provided with a connection structure for electrical connection.

16. The lamp according to claim 15, wherein the connection structure is suitable for retrofitting into a luminaire arranged for the utilization of an incandescent light source.

17. A light assembly comprising:

a light source according to claim 1; and a luminaire for accommodating the light source;

wherein the radius of a virtual hemisphere tangent to the light source is at least 10 times smaller than the radius of a virtual hemisphere tangent to the luminaire.

18. The light assembly according to claim 17, wherein the radius of the virtual hemisphere tangent to the light source is smaller than 50 mm.

19. The light assembly according to claim 18, wherein the radius of the virtual hemisphere tangent to the light source is smaller than 25 mm.

20. A method of manufacturing a light source comprising:

forming a light unit by distributing a plurality of light emitting diodes in a spatial arrangement of the plurality of light emitting diodes, the spatial arrangement having a center position, the plurality of light emitting diodes including at least two different types of diodes, each type of diode being configured to emit light within a different wavelength range;

molding a hollow curved cap being substantially transparent to radiation emitted by the light unit, the cap being provided with an axially symmetric protrusion forming an exposed depression in the exterior of the cap; and placing the cap over the light unit so as to cover it, wherein the placement is such that a surface of the protrusion, which is convex with respect to the plurality of light emitting diodes, at least partially defines a cavity in which the plurality of light emitting diodes is disposed, and the symmetry axis of the protrusion substantially coincides with the center position of the spatial arrangement of the plurality of light emitting diodes.

21. The method of claim 20, wherein the molding includes supporting the cap such that the protrusion comprises a center hole.

22. A light source comprising:

a light unit comprising a plurality of light emitting diodes distributed a spatial arrangement of the plurality of light emitting diodes, the spatial arrangement having a center position; and a hollow curved cap covering the light unit, the cap being substantially transparent to radiation emitted by the light unit and being provided with an axially symmetric protrusion forming an exposed depression in the exterior of the cap, wherein the protrusion includes a surface that is convex with respect to the plurality of light emitting diodes and that at least partially defines a cavity in which the plurality of light emitting diodes is disposed, and wherein the symmetry axis of the protrusion substantially coincides with the center position of the spatial arrangement of the plurality of light emitting diodes.

23. The light source of claim 22, wherein the protrusion at least partially forms a surface that both is concave with respect to the plurality of light emitting diodes and further defines the cavity.

* * * * *